United States Patent [19]

Bridges et al.

[11] Patent Number: 4,524,827

[45] Date of Patent: Jun. 25, 1985

[54] SINGLE WELL STIMULATION FOR THE RECOVERY OF LIQUID HYDROCARBONS FROM SUBSURFACE FORMATIONS

[75] Inventors: Jack E. Bridges, Park Ridge; Allen Taflove, Wilmette; Guggilam C. Sresty, Chicago, all of Ill.

[73] Assignee: IIT Research Institute, Chicago, Ill.

[21] Appl. No.: 489,756

[22] Filed: Apr. 29, 1983

[51] Int. Cl.[3] ..... E21B 36/00

[52] U.S. Cl. ..... 166/248; 166/302; 166/57; 166/60

[58] Field of Search ..... 166/57, 60, 65 R, 248, 166/257, 302

[56] References Cited

U.S. PATENT DOCUMENTS

| | | | |
|---|---|---|---|
| Re. 30,738 | 9/1981 | Bridges et al. | 166/248 |
| 1,784,214 | 12/1930 | Workman . | |
| 2,118,669 | 5/1938 | Grebe . | |
| 3,137,347 | 6/1964 | Parker . | |
| 3,141,099 | 7/1964 | Brandon . | |
| 3,149,672 | 9/1964 | Orkiszewski et al. | 166/39 |
| 3,189,088 | 6/1965 | Cronberger | 166/25 |
| 3,211,220 | 10/1965 | Sarapuu | 166/39 |
| 3,417,823 | 12/1968 | Faris | 166/248 |
| 3,507,330 | 4/1970 | Gill | 166/248 |
| 3,530,936 | 9/1970 | Gunderson et al. | 166/248 |
| 3,547,193 | 12/1970 | Gill | 166/248 |
| 3,620,300 | 11/1971 | Crowson | 166/248 |
| 3,642,066 | 2/1972 | Gill | 166/248 |
| 3,718,186 | 2/1973 | Brandon | 166/248 |
| 3,766,980 | 10/1973 | Kern | 166/248 |
| 3,862,662 | 1/1975 | Kern | 166/248 |
| 3,874,450 | 4/1975 | Kern | 166/248 |
| 3,878,312 | 4/1975 | Bergh et al. | 174/9 F |
| 4,010,799 | 3/1977 | Kern et al. | 166/248 |
| 4,084,639 | 4/1978 | Todd | 166/248 |
| 4,124,483 | 11/1978 | Christenson | 166/248 |
| 4,140,179 | 2/1979 | Kasevich et al. | 166/248 |
| 4,382,469 | 5/1983 | Bell et al. | 166/248 |

OTHER PUBLICATIONS

Todd, J. C., and E. P. Howell, "Numerical Simulation of *In Situ* Electrical Heating to Increase Mobility," Oil Sands, 1977, pp. 477–486.

Gill, W., "The Electrothermic System for Enhanced Oil Recovery, " 1st Unitar Conference on the Future of Heavy Crude Oil and Tar Sands, Jun. 1979, pp. 469–473.

TEC Brochure.

*Primary Examiner*—Stephen J. Novosad
*Assistant Examiner*—William P. Neuder
*Attorney, Agent, or Firm*—Fitch, Even, Tabin & Flannery

[57] ABSTRACT

Water is vaporized in an annular upper region of a subsurface formation into which borehole extends from the surface. This creates a substantially nonconducting dielectric in such region extending outwardly from the borehole. Such vaporization is preferably achieved by the application of electrical power to an electrode disposed in the borehole. Liquid is produced through the borehole from a lower region of the formation to cool the lower region near the borehole and maintain an electrically conductive path between the formation and the electrode in such lower region through which electrical power is applied to the formation.

32 Claims, 4 Drawing Figures

PUMP MOTOR
54
57
56
62
30
COMPRESSOR REGULATOR
44
45
26
49
46
RF SOURCE
47
P1
64
34
32
DRY GAS SF6
P2
36
48
72
58
60
50
70
12
30
10
18
14
50
28
40
42
43
38
OVERBURDEN
58
66
16
20
30
VAPOR GAS
VAPOR GAS
74
RESERVOIR
24
68
35
59
22
52
UNDERBURDEN
17

PUMP MOTOR
54
64
P
62
COMPRESSOR REG.
57
86
85
PUMP
56
80
60
70
72
88
84
90
12
82
10
58
78
14
OVERBURDEN
58
18
66
VAPOR GAS
VAPOR GAS
74
76
RESERVOIR
16
59
68
52
59
UNDERBURDEN
17

PUMP MOTOR
54
62
COMPRESSOR REG.
57
64
95
94
56
92
96
60
72
70
12
10
58
82
18
14
78
58
OVERBURDEN
66
VAPOR GAS
74
VAPOR GAS
16
76
RESERVOIR
59
68
52
59
UNDERBURDEN
17

PUMP MOTOR
54
COMPRESSOR REGULATOR
62
57
64
56
+ D.C. - SUPPLY
30
72
90
80
58
60
28
70
82
12
84
30
98
10
18
14
OVERBURDEN
58
97
66
VAPOR GAS
74
52
76
16
RESERVOIR
59
68
17

SINGLE WELL STIMULATION FOR THE RECOVERY OF LIQUID HYDROCARBONS FROM SUBSURFACE FORMATIONS

BACKGROUND OF THE INVENTION

This invention relates generally to the recovery of marketable hydrocarbons such as oil and gas from hydrocarbon bearing deposits such as heavy oil deposits or tar sands by the application of electrical energy to heat the deposits. More specifically, the invention relates to the heating of such deposits from a single borehole and recovering hydrocarbons from such borehole wherein the deposits are heated by the controlled application of electrical power at the deposit. Still more specifically, the invention relates to the controlled and efficient application of power and withdrawal of liquid hydrocarbons to vaporize water in the upper portion of a deposit and maintain an annular region of water vapor extending from the borehole into the upper portion of deposit, thereby providing a non-conductive dielectric for directing electrical power deeper into the deposit.

In many deposits, especially in medium and heavy oil deposits, the viscosity of the oil impedes flow, especially in the immediate vicinity of the borehole through which the oil is being produced. As all of the oil must flow into the borehole, the mobility of the fluid in the immediate vicinity of the borehole dominates the production rate, wherefore any impediment to fluid flow at the borehole is particularly unwelcome. It has, therefore, been known to heat the formations, particularly in the vicinity of the borehole, to lower the viscosity of the liquids in the deposit and, hence, provide greater mobility and more profitable production.

Steam injection has been used to heat the deposit to reduce the viscosity of oil in the immediate vicinity of a borehole, and to some extent steam can be used as a heat transport medium. Steam injection can be used in some deposits for economically stimulating production. However, if steam is injected from the surface, it loses a large amount of heat as it progresses down the hole, wastefully heating formations above the formations of interest. This has given impetus to the development of downhole steam generators, which have problems of their own. Further, the use of steam stimulation is uneconomic in many deposits.

As a consequence, a number of electrical heating methods have been considered. It is known to provide uniform heating of a deposit by interwell energization, as shown, for example, in Bridges and Taflove U.S. Pat. No. Re. 30,738. Such methods, however, require a relatively extensive array of boreholes and comprehensive development of a field, which is not always warranted. Single well heating is shown in Sarapuu U.S. Pat. No. 3,211,220, which shows the application of electrical power between an electrode in a formation and a distributed electrode at or near the earth's surface.

It has been recognized that single well stimulation is more effective if heat can be applied some distance into the formations from a borehole, as by causing electrical energy to flow into the formations some distance from the borehole. To this end, it has been suggested to extend the borehole laterally and extend the electrodes themselves out into the formations. See, for example, Kern U.S. Pat. No. 3,874,450, Todd U.S. Pat. No. 4,084,639, Gill U.S. Pat. No. 3,547,193, Crowson U.S. Pat. No. 3,620,300 and Orkiszewski el al. U.S. Pat. No. 3,149,672. All of such systems require special downhole development, generally requiring special tools or operations to clear out a portion of the formation for entry of the electrode.

In Crowson U.S. Pat. No. 3,620,300 is shown a method and system wherein not only the electrodes but insulating barriers are extended out into the formations, thereby increasing the effective diameter of the borehole. Such method and system require physical enlargement of the borehole to admit the enlarged electrodes and insulating barriers. Such method and system include the emplacement of such a barrier extending into the formation from the borehole above a single electrode (monopole) also extending into the formation from the borehole, as well as the emplacement of such barrier between a pair of vertically spaced electrodes (dipole) in the same borehole.

SUMMARY OF THE INVENTION

It is an aspect of the present invention to force the electrical currents back into the formations around a borehole without the need for emplacing a barrier or enlarging the borehole for the emplacement of such barrier or electrodes. The method of the present invention is performed in a formation in which water is present in the interstitial spaces in a low-loss medium, such as quartz sandstone. As water is naturally present in most formations, this presents no problem. Such a condition forms a heterogeneous dielectric, which results in high dielectric losses and conduction currents when moist and low dielectric losses and conduction currents when dry. In accordance with the present invention, water is vaporized in an annular upper region of a subsurface formation into which a borehole extends from the surface. This creates a substantially nonconducting dielectric in such region extending outwardly from the borehole. Such vaporization is preferably achieved by the application of electrical power to an electrode disposed in the borehole. Liquid is produced through the borehole from a lower region of the formation to cool the lower region near the borehole and maintain an electrically conductive path between the formation and the electrode in such lower region.

Thus, in accordance with the present invention, the upper region of a deposit is heated to vaporize the moisture therein and suppress ionic or conduction current flow as well as dielectric losses. This upper region is not produced; hence, the region remains nonconducting and relatively lossless near the borehole, and heat is added as needed to maintain the region full of vapor. The lower region of the deposit is produced, whereby the ingress of cooler liquids from the formations at a distance from the borehole prevent substantial vaporization of moisture at the electrode in such lower region.

In one aspect of the present invention, a pair of electrodes are disposed in the borehole within the formation, with the electrodes vertically spaced and insulated from one another. High frequency electrical power is applied between the electrodes (as a dipole) by sending such power down a coaxial conductor assembly. Energy is applied at such rate as to vaporize water around the upper of the two electrodes so that it is thereafter insulated from the formation, permitting only displacement currents to flow therefrom. Meanwhile, liquid is withdrawn through the borehole from the lower region about the lower electrode, assuring a conductive path between the formation and the lower electrode.

In another aspect of the present invention, a single electrode (monopole) is disposed in the borehole within the formation, and low frequency or d.c. electrical power is applied between the borehole electrode and a remote distributed electrode. Energy is supplied at such rate as to vaporize water around the upper portion of the electrode, while liquid is withdrawn at the lower portion thereof. This provides a conductive path between the lower portion of the electrode and the lower region of the formations and substantially precludes the flow of low frequency or direct current to the upper region of the formation, hence assuring flow out into the formation.

It is a further aspect of the present invention to control the rate of application of electrical energy and the rate of liquid withdrawal in order to control downhole pressure and temperature and provide maximum heat transfer to the adjacent formation without coking or adversely affecting autogenous gas drive. Such control allows the optimization of oil produced per kilowatt hour of electrical power.

Another aspect of this invention is to provide an efficient and relatively loss-free power delivery system. Steel pipe is the preferred casing and conductor material. It can, however, exhibit excess losses due to skin effect phenonoma, especially where the skin depth $\delta$ is comparable to or smaller than the wall thickness of the steel casing. Since $$\delta = \left(\frac{\omega\mu_s\sigma_s}{2}\right)^{-\frac{1}{2}},$$

where $\omega$ is the radian frequency, $\mu_s$ is the permeability of steel and $\sigma_s$ is the conductivity of steel, reducing the frequency to a point where $\delta$ is substantially larger than the wall thickness of the conductor will reduce this excess loss to a point where it is negligible compared to the d.c. $I^2R$ losses. Since skin depths in steel are on the order of 0.25 inches at 60 Hz, an excitation frequency well below 60 Hz is required for low skin effect losses.

Another source of loss in the delivery system can occur when the current from the surface is injected into the formation from an electrode and returns through all or a portion of the barren earth media to the surface and when the current is injected via an insulated conductor surrounded by a steel pipe or casing. In the latter case, a circumferential magnetic field is established in the casing material which gives rise to large magnetic fields in the casing. Even at frequencies as low as power frequencies, the flux reversal every 1/120 of a second in the ferromagnetic casing leads to significant hysteresis and eddy current losses. These losses can be reduced by reducing the frequency. Another solution is to deliver the power into the deposit via an insulated steel casing while allowing the return current to flow through the earth to a low-impedance ground at the surface.

For very deep wells, the attenuation effect of the earth media on the current which returns via the earth media also must be considered. Here the idealized plane-wave attenuation of the earth $\alpha_e$ is in accordance with the equation:

$$\alpha_e = \left(\frac{\omega\mu_e\sigma_e}{2}\right)^{\frac{1}{2}}$$

where $\omega$ is the radian frequency and $\mu_s$ and $\sigma_s$ are the permeability and conductivity of the earth, and can also be reduced by reducing the frequency.

Thus, if the heating is to be done by conduction currents in the deposit, the frequency should be selected to be quite low, and could be considerably less than 50 or 60 Hz.

Thus a goal for efficient power delivery should be to reduce the frequency of the main spectral components of the applied energy to a point where the excess loss contributions—as caused by skin effects on the surface of the power delivery conductors, the eddy-current and hysteresis losses from circumferential flux in the steel, and the return current earth media path losses—are small compared to the overall path losses experienced if the power were d.c.

Other aspects and advantages of the present invention will become apparent from consideration of the following detailed description, particularly when taken with the accompanying drawings.

DETAILED DESCRIPTION OF THE PREFERRED EMBODIMENTS

Figure 1:
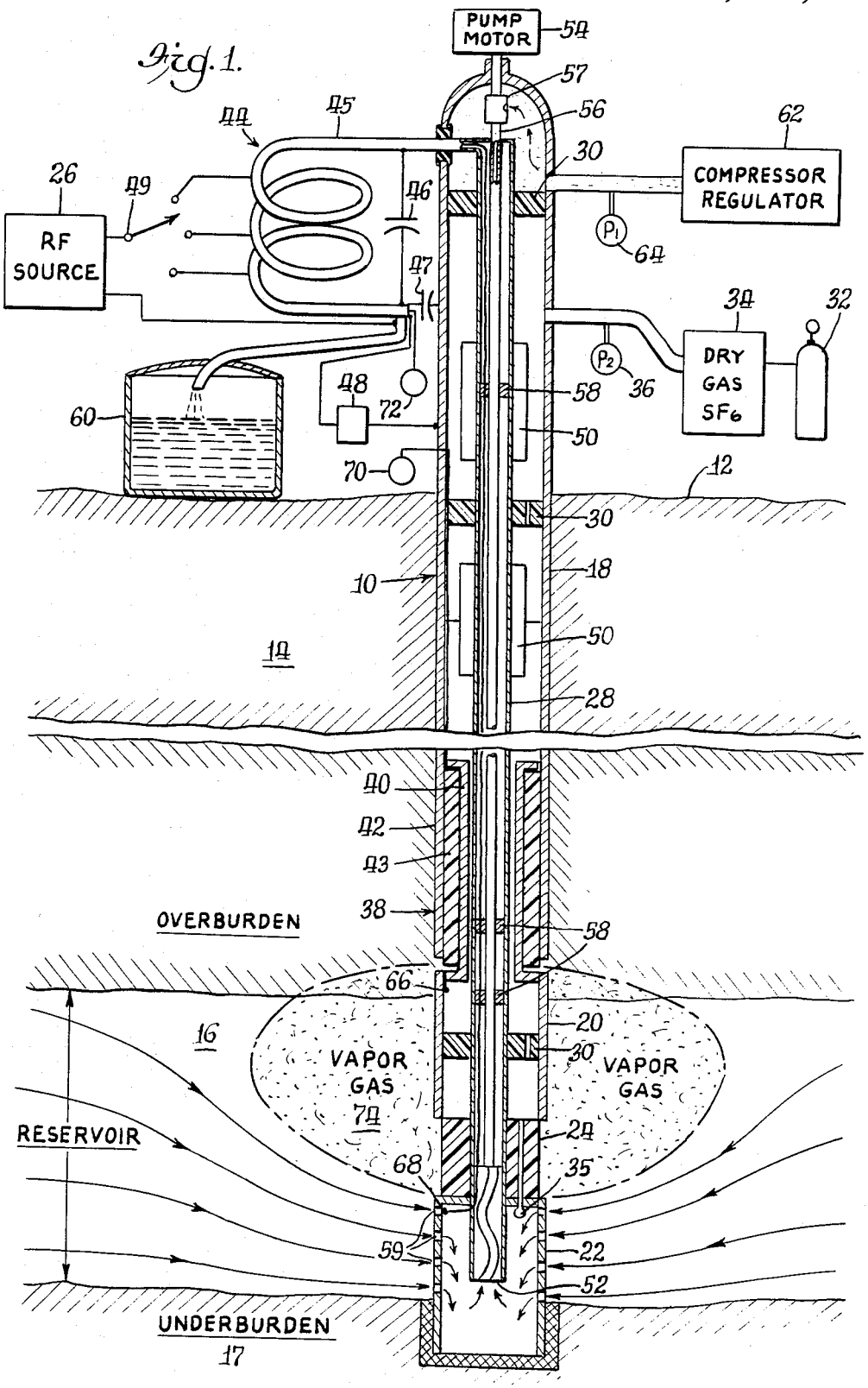
FIG. 1 is a vertical sectional view, partly diagrammatic, illustrating one form of apparatus for the controlled heating of the formation of interest and the withdrawal of liquid hydrocarbons therefrom in accordance with the present invention, using dipole heating at high frequency.

In FIG. 1 is illustrated a system for recovering liquid hydrocarbons from the formations in accordance with one preferred embodiment of the present invention. A borehole 10 is drilled into the earth to extend from the earth's surface 12 through the overburden 14 and into the formation 16 from which liquid hydrocarbons are to be recovered. The formation 16 overlies the underburden 17. The borehole 10 is cased with casing 18 over most of its length through the overburden 14 in a conventional manner. That is, the casing 18 may comprise lengths of steel pipe joined together and cemented in place in the borehole 10. A pair of electrodes 20, 22 are disposed in the borehole 10 within the formation 16 in vertically spaced relation and are insulated from one another by an insulator 24. The upper electrode 20 is disposed in an upper part of the formation 16, and the lower electrode 22 in a lower part thereof.

In the case of an embedded dipole, it may be desirable to insulate the deposit from the feed point between the electrodes. The insulator 24 serves two functions: (1) to prevent electrical breakdown in the deposit, and (2) to assist in deflecting current flow outward into the deposit. The length of the insulator 24 should be at least one eighth of the deposit thickness to suppress excess charge concentration and assist in forcing current outward into the formations.

Electrical power is supplied to the electrodes 20, 22 as a dipole from a high frequency source 26 on the earth's surface 12. As shown, the power is supplied over a coaxial conductor system, the outer conductor of which is the casing 18, and the inner conductor of which is production tubing 28, spaced and insulated from one another by insulating spacers 30. The conductors are further insulated from one another by dry gas, such as $SF_6$, supplied from a source 32 and supplied through a pressure regulator 34. Such gas may pass through the lower spacers 30 and bleed out via a check valve 35 at the bottom of the system through the insulator 24, and pressure may be measured by a pressure gauge 36. At the bottom of the borehole 10, the upper electrode 20 may be coupled to the bottom of the casing 18 through a quarter-wavelength choke 38 formed by an inner section 40 and a sleeve 42 separated by an insulator 43. The choke 38 serves to restrict current flow on the casing 18. At the surface, the power source 26 is coupled to the coaxial conductor system by a tuned choke 44, which may be in the form of an auto-transformer 45 and a capacitor 46. The choke 44 is connected to the casing 18 by a capacitor 47 across which an impedance meter 48 is connected. A tap connector 49 may be used for impedance matching. Matching elements 50 may also be used.

A positive displacement downhole pump 52 is used to pump liquid to the surface through the tubing 28. The pump 52 may be driven from the surface by a pump motor 54 using a drive shaft 56 insulated from the motor 54 by an insulated coupling 57 and supported from the tubing 28 by permeable supports 58. The liquid passes through perforations 59 in the lower electrode 22 and is pumped from the bottom of the borehole. The liquid passes up the borehole and through the interior of the upper choke 44 so as to exit at ground potential into a storage tank 60.

To provide a measure of downhole pressure, gas is introduced through the drive shaft 56 from a pressure regulated source 62 of gas, the pressure of which is indicated by a gauge 64. This gas is separated from the insulating gas by the top spacer 30, which is impermeable. By increasing pressure until gas flow begins, the pressure at the bottom of the borehole can be determined. Borehole temperature at the respective electrodes 20, 22 may be determined by respective sensors 66, 68 coupled to respective indicators 70, 72 at the surface.

In operation, controlled electrical power is applied from the source 26 to the electrodes 20, 22 while pumping liquid from the bottom of the borehole 10. By measuring downhole temperatures and pressure and/or the power consumption and/or load impedance, the operator may determine when moisture in the upper part of the formation 16 adjacent the upper electrode 20 vaporizes, as it effects a change in impedance and a differential in temperature. A nonconductive annular region 74 is formed at the top of the formation 16. Displacement current then flows from the upper electrode 20 through the region 74 back into the formation 16. Further, the vapor transfers heat to the surrounding formation. The liquid at and near the interface between the annular region 74 and the adjacent formation is heated, reducing its viscosity. The liquid then flows by gravity and solution gas drive pressure differentials toward the borehole 10, whence it is pumped to the surface 12. The region 74 enlarges the effective borehole without any mechanical or chemical treatment and without having to introduce an insulating barrier as in the Crowson patent. The heating pattern provides higher temperatures nearer the borehole 10, which is desirable as there is a greater flow area remote from the borehole. Gas drive is produced autogenously by the heating.

The rates at which electrical power is applied and liquid is removed are controlled to provide an optimum rate of recovery for the amount of power consumed. Power is applied at voltages that do not cause electrical breakdown in the formations. Further, in one embodiment the impedance of the power circuit including the electrodes is measured, and the rate at which power is applied to the electrodes and the rate of production of liquid are controlled to maintain the impedance in a predetermined range. Such range is that where the impedance is characteristic of a region 74 covering the upper electrode 20 while leaving the lower electrode 22 in conducting relationship with the lower part of the formation 16. In another embodiment, the temperature of the formations at the respective electrodes 20 and 22 (indicative of formation temperatures at the two levels) and the downhole pressure are measured, and the rate at which power is applied and the rate of production of liquid are controlled to maintain the temperature of the deposit near the upper electrode above the boiling point of water and the temperature at the lower electrode below the boiling point of water, the pressure being indicative of the boiling point.

Figure 2:
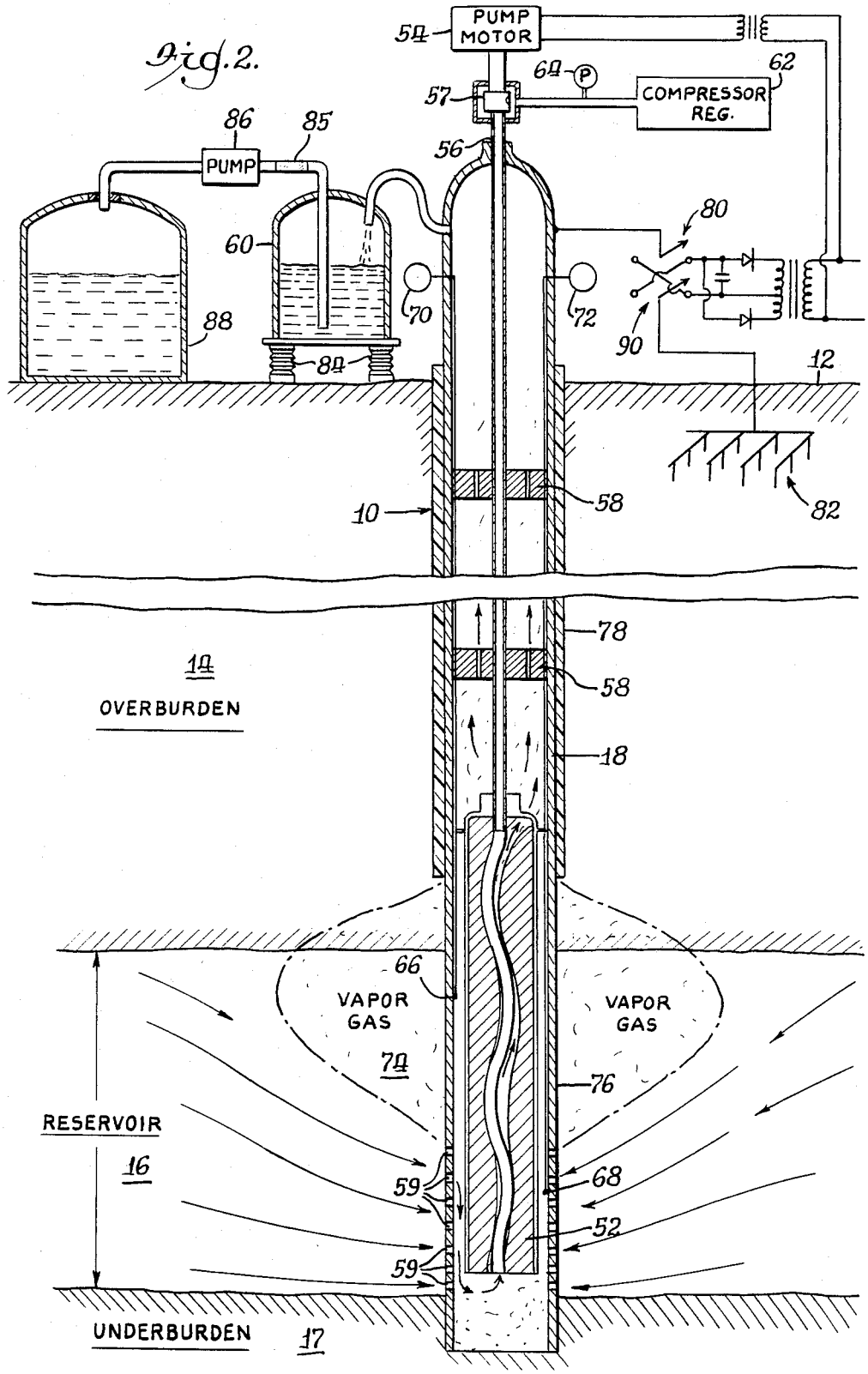
FIG. 2 is a vertical sectional view, partly diagrammatic, illustrating an alternative form of apparatus for the controlled heating of the formation of interest and the withdrawal of liquid therefrom in accordance with another aspect of the present invention, using monopole heating with d.c.

In FIG. 2 is illustrated a system for recovering liquid hydrocarbons from the formations in accordance with an alternative embodiment of the present invention. The system has many elements in common with the system shown in FIG. 1, and such elements are identified by the same reference numerals. In this system a single downhole electrode 76 (monopole) is used, and it is connected directly to the casing 18, which is insulated by insulation 78 from the surface 12 to the electrode 76. Power is supplied from a d.c. power supply 80 or a very low frequency source between the single electrode 76 (via the casing 18) and a distributed remote electrode 82 at or near the surface 12. The distributed electrode 82 has a very large area, providing a relatively negligible impedance as compared to the impedance at the smaller electrode 76. As the same current flows through both electrodes, this assures that the major power dissipation occurs at the electrode 76, where it is desired. The remote electrode 82 may surround the borehole 10.

In this case, liquid is pumped up the casing 18 itself without the need for tubing. As the casing is at an elevated potential, the tank 60 is isolated from ground by insulators 84 and 85. The oil may be taken from the tank 60 by an insulated pump 86 to a storage tank 88 from time to time.

In operation, controlled electrical power is applied from the source 80 between the downhole electrode 76 and the remote electrode 82. A reversing switch 90 may be used to change the polarity of the d.c. power from time to time to limit corrosion of the casing and electrodes. On the other hand, in accordance with one embodiment of the invention, the power supply may be poled at all times in the direction aiding the production of oil by electro-osmosis. Downhole temperatures and pressure may be sensed in the manner described above in connection with FIG. 1. In this case, the operator measures the different downhole temperatures and the pressure, and controls the rates of power application and withdrawal of liquid as stated above. Alternatively, he may measure the impedance of the system and control power and pumping rates much as indicated above. An optimum heating rate is achieved when the power is slowly increased and the impedance no longer decreases with increased power but begins to increase, indicating vaporization over the upper part of the downhole electrode. It is also possible to determine appropriate power from rate of production of product.

Figure 3:
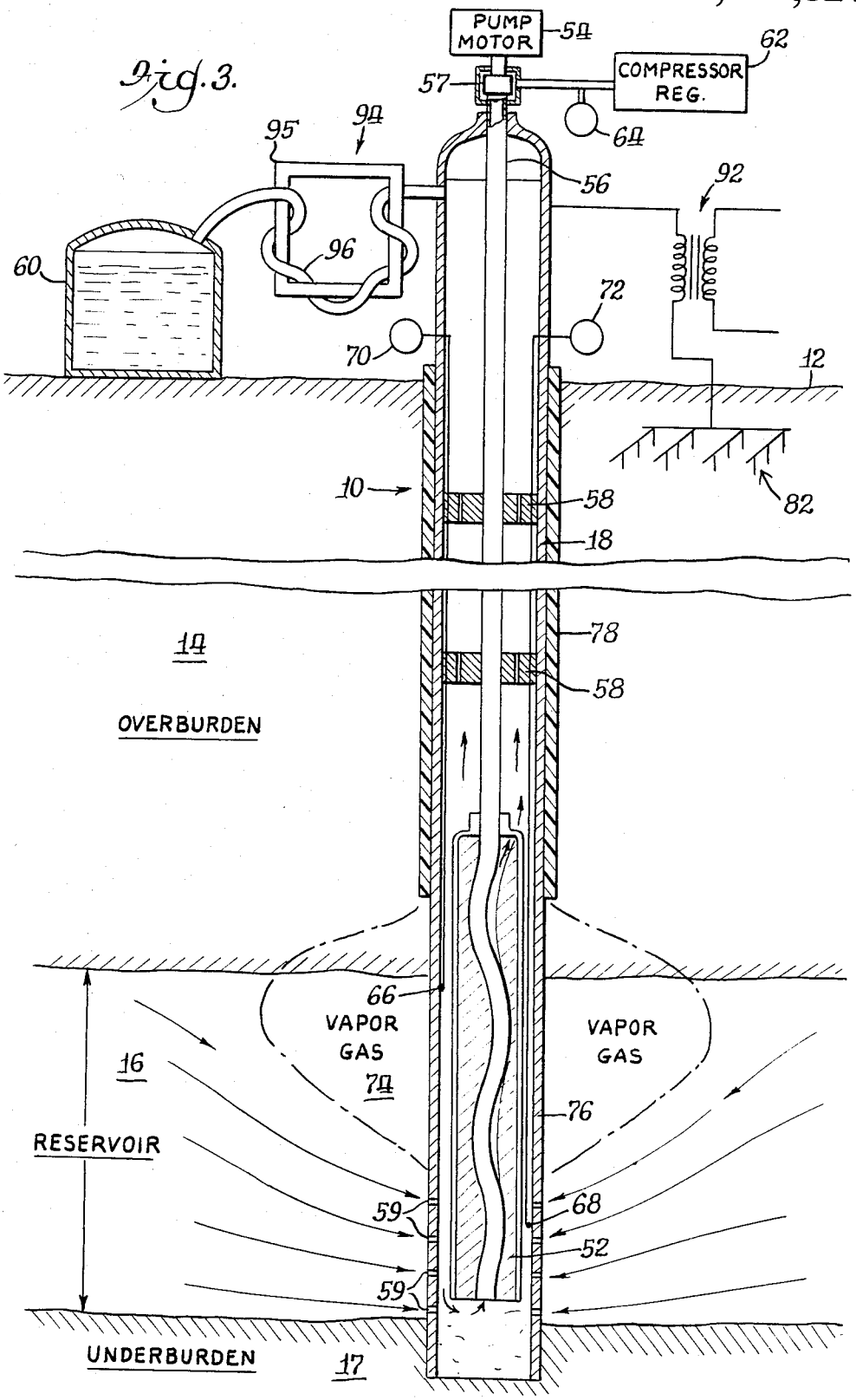
FIG. 3 is a vertical sectional view, mostly diagrammatic, illustrating an alternative form of the apparatus shown in FIG. 2, with a low frequency power source and monopole.

It is also possible to operate the system of FIG. 2 at low frequency. An alternative low frequency system is shown in FIG. 3, where elements common to those of FIGS. 1 and 2 are identified by the same reference numerals. The system uses a low frequency source 92 and an electrical choke 94 in the production line to decouple the tank 60. The choke 94 may be in the form of an iron core 95 around which the withdrawal pipe 96 is wound. This system operates much as described above in connection with FIG. 2.

Figure 4:
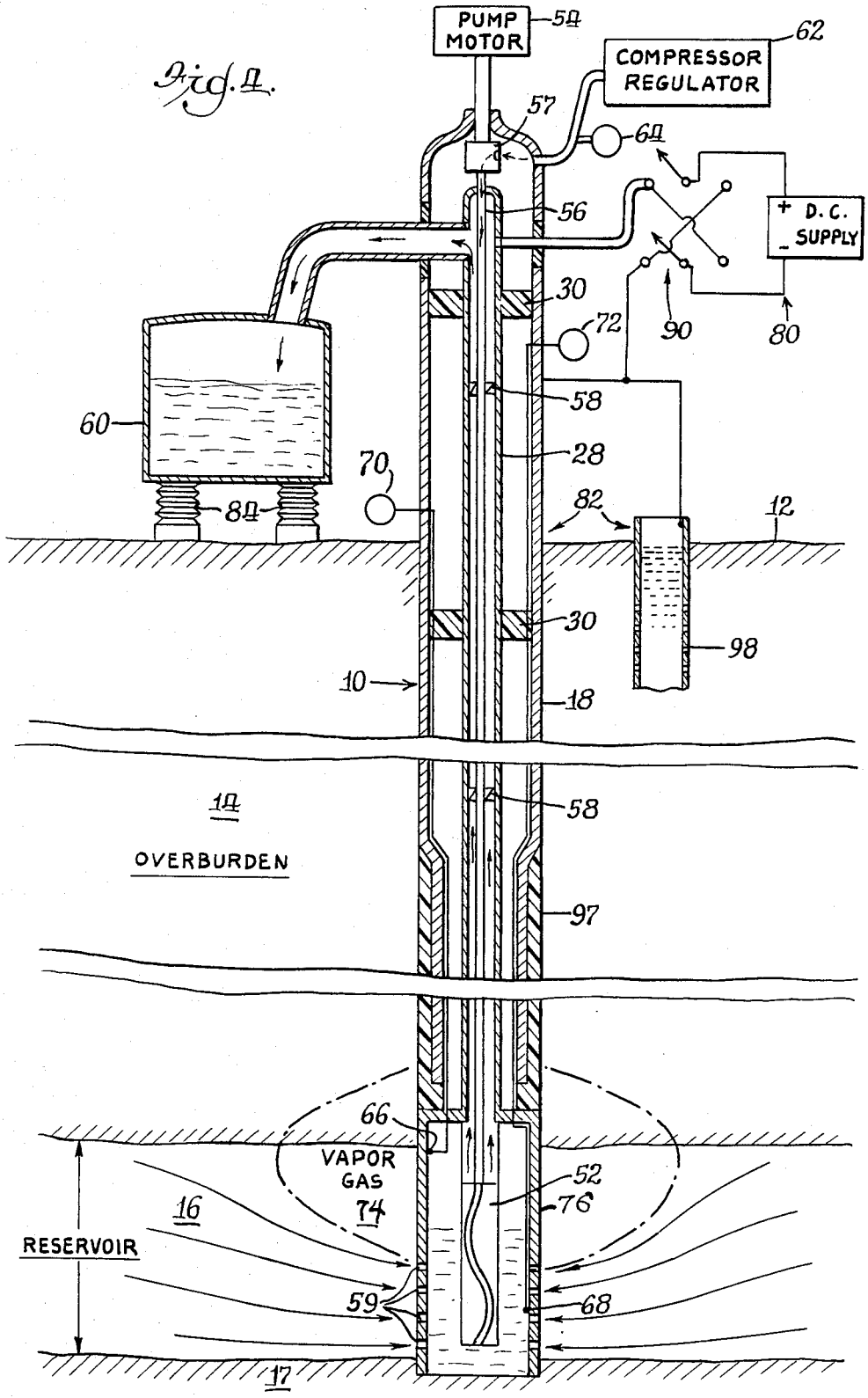
FIG. 4 is a vertical sectional view, mostly diagrammatic, illustrating still another form of the apparatus shown in FIG. 2, with d.c. power and a monopole, with the casing forming a remote electrode.

FIG. 4 illustrates another form of monopole system wherein the casing 18 comprises all or part of the remote electrode 82. Elements common to those of FIGS. 1, 2 and 3 are identified by the same numerals. In the case of the monopole, it may be desirable to avoid insulating the entire casing string, in which case a limited length of insulated casing can be employed. This insulation is provided upward from the top of the reservoir to at least two reservoir heights above the reservoir top. This is needed to suppress charge concentration and hence current concentration and excess heating or evaporation at the point where the insulation ends. In this case the casing is insulated with insulation 97 a substantial distance, at least twice the formation thickness, up the casing from the formation. In this particular embodiment, the remote electrode also includes a well 98 filled with electrolyte. This system operates much as described above in connection with FIG. 2.

Other variations in the apparatus may be utilized in performing the method of the present invention, which itself may take a number of forms. As noted above, the monopole systems may operate at d.c. or low frequency. High frequencies may not be used because of eddy current, skin depth, hysteresis and earth propagation losses. In general, the frequencies for the monopole systems should be less than power frequencies, 60 Hz, and less than the frequency at which skin depth losses, eddy current losses and hysteresis losses total less than path losses at d.c.

Initially it is expected that the impedance of the lower electrode 22 or the monopole 76 to the earth will decrease with increasing temperature of the surrounding earth media. This is because the conductivity of the connate water increases with temperature. Eventually, as the water evaporates near the top of the electrode, the consequent reduction of contact area tends to increase the impedance, although this may not offset entirely the decrease in impedance realized for the area of the electrode in ionic contact with the deposit. Eventually, the increased impedance due to loss of ionic contact dominates. Thus the initial indication of the establishment of the vapor zone is the bottoming out of the impedance as a function of downhole temperature. Further increases in heating rate will cause a rise in the impedance. Thus monitoring the impedance of the electrode to earth provides a convenient indication of bottom hole heating conditions. This also allows varying the heating rate such that the desired ionic contact is maintained.

In the case of very thick deposits, it may be desirable to form the annular reduced conductivity ring 74 larger and more toward the center of the deposit. This may be done by employing a long insulated section 24 between the electrodes of an embedded dipole wherein the electrodes 20, 22 are located respectively near the upper and lower parts of the reservoir.

Vaporization and the establishment of the nonconducting annular ring 74 may be produced at one frequency and production sustained at another frequency. For example, it may not be desirable to prematurely produce the deposit by electro-osmosis until the nonconducting ring 74 is formed. Thus, an alternating current could be used to establish the ring 74, and d.c. then used to sustain heating and oil production by electro-osmosis.

The ring 74 may be created by overpressurizing the deposit briefly, and allowing the temperature to rise in the annular ring substantially via conduction or displacement current heating. The pressure may then be reduced to the working pressure, causing vaporization of the moisture in the annular ring. This remains dry, as fluids are not produced in this region.

The vaporization temperature is controlled by the deposit pressure. High temperatures are preferred since these reduce the viscosity and therefore enhance the mobility and the heat delivered to more distant portions of the deposit. There are two limiting factors: (1) the temperature at which coking occurs, and (2) the solution gas pressures. Therefore, the working pressure and, hence, vaporization temperature should be lower than either of the above values. Monitoring the gaseous effluents can assist in determining whether or not coking is taking place, such as by an increase in hydrogen and light hydrocarbon gases.

What is claimed is:

1. A method for recovering liquid hydrocarbons from a water-containing subsurface formation through a borehole extending from the surface of the earth into said formation, said method comprising the steps of:
   - disposing an electrode in said borehole in at least a first portion of said formation,
   - producing liquid through said borehole from said first portion of said formation, and
   - applying electrical power through said electrode at a rate sufficient to vaporize water in an annular region of said formation extending from said borehole above said first portion while leaving water in said first portion substantially in the liquid phase.

2. A method for recovering liquid hydrocarbons from a water-containing subsurface formation through a borehole extending from the surface of the earth into said formation, said method comprising the steps of:
   - vaporizing water in an annular upper region of said formation extending from said borehole to create a substantially nonconducting dielectric therein,
   - applying electrical power to an electrode disposed in said borehole in a lower region of said formation to heat hydrocarbons therein, and
   - producing liquid including hydrocarbons through said borehole from said lower region to cool said lower region adjacent said electrode and maintain an electrically conductive path between said formation and said electrode in said lower region.

3. A method according to claim 2 wherein said electrode comprises a monopole and electrical power is applied between said monopole and a distributed electrode outside said formation having an effective impedance thereat that is negligible relative to the impedance at said monopole, said power being applied both to vaporize said water in said annular region and to heat said lower region.

4. A method according to claim 3 wherein the impedance at said electrode outside said formation is made less than one fifth that at said monopole.

5. A method according to claim 3 wherein said electric power is applied at very low frequency.

6. A method according to claim 5 wherein said frequency is less than 60 Hz.

7. A method acording to claim 3 wherein said electric power is applied as direct current.

8. A method according to claim 7 wherein said direct current is poled to drive hydrocarbons to said monopole electrode by electro-osmosis.

9. A method according to claim 7 wherein the polarity of said direct current is reversed from time to time.

10. A method according to any one of claims 3 to 9 wherein power is applied to said monopole through well casing insulated from earth formations from the surface of the earth to said monopole.

11. A method according to claim 3 including forming said electrode outside said formation at least in part by well casing in said borehole above said monopole.

12. A method according to claim 11 including insulating said casing for a substantial distance from said monopole.

13. A method according to claim 12 including insulating said casing above said formation for a distance equal to at least twice the thickness of said formation.

14. A method according to claim 2 wherein said electrical power is applied between a pair of vertically spaced electrodes to vaporize said water in said annular region adjacent the upper one of said pair and to heat said lower region adjacent said lower electrode.

15. A method according to claim 14 wherein said electrical power is applied at high frequency.

16. A method according to claim 15 wherein said power is applied to provide displacement current at said upper electrode without electrical breakdown.

17. A method according to claim 16 wherein said power is applied to said pair of electrodes vertically spaced by insulating means by at least one eighth the thickness of said formation.

18. A method according to any one of claims 2 to 9 or 11 to 17 wherein the impedance of the power circuit including said electrode disposed in said borehole is measured, and the rate at which power is applied to said electrode in said borehole and the rate of production of liquid through said borehole are controlled to maintain said impedance in a predetermined range.

19. A method according to any one of claims 2 to 9 or 11 to 17 wherein the temperature of the formations at respective vertically spaced locations in the borehole and the downhole pressure are measured and the rate at which power is applied to said electrode in said boreholes and the rate of production of liquid through said borehole are controlled to maintain the temperature at the upper said location above the boiling point of water and the temperature at the lower said location below the boiling point of water.

20. A method according to any one of claims 2 to 9 or 11 to 17 wherein a higher frequency is used to form the reduced conductivity annular region and a lower frequency or d.c. is used to sustain heating and production.

21. A method according to any one of claims 1 to 9 or 11 to 17 including transferring heat to adjacent formations by vaporized water.

22. A method for recovering liquid hydrocarbons from a water-containing subsurface formation through a borehole extending from the surface of the earth into said formation, said method comprising the steps of:

vaporizing water in an annular upper region of said formation extending from said borehole to create a substantially nonconducting dielectric therein, applying electrical power to an electrode disposed in said borehole in a lower region of said formation to heat hydrocarbons therein, and producing liquid including hydrocarbons through said borehole from said lower region to cool said lower region adjacent said electrode and maintain an electrically conductive path between said formation and said electrode in said lower region, wherein said electrode comprises a monopole and electrical power is applied at a very low frequency between said monopole and a distributed electrode outside said formation having an effective impedance thereat that is negligible relative to the impedance at said monopole, said power being applied both to vaporize said water in said annular region and to heat said lower region, said frequency being less than that at which excess total path losses, including skin-depth effect losses, eddy current losses and hysteresis losses and frequency dependent earth path losses, total less than total path losses at zero frequency.

23. A system for electrically heating a subsurface formation remote from the surface of the earth through a borehole extending from the surface of the earth into said formation, said system comprising a source of electrical power at the surface of the earth, an electrode in said borehole in at least a portion of said formation, a remote electrode at the surface of the earth, an electrically conductive well casing extending from the surface of the earth to said electrode in said borehole, means for insulating said well casing from earth formations from the surface of the earth to said electrode in said borehole, means for connecting said source of electrical power between said remote electrode and said well casing for applying electrical power to said formation at said electrode in said borehole, and means for measuring the impedance of the power circuit including said electrode in said borehole.

24. A system for electrically heating a subsurface formation remote from the surface of the earth through a borehole extending from the surface of the earth into said formation, said system comprising a source of electrical power at the surface of the earth, an electrode in said borehole in at least a portion of said formation, a remote electrode at the surface of the earth, an electrically conductive well casing extending from the surface of the earth to said electrode in said borehole, means for insulating said well casing from earth formations from the surface of the earth to said electrode in said borehole, means for connecting said source of electrical power between said remote electrode and said well casing for applying electrical power to said formation at said electrode in said borehole, means for measuring the temperature at respective vertically spaced locations in said borehole, and means for measuring the downhole pressure.

25. A system for electrically heating a subsurface formation remote from the surface of the earth through a borehole extending from the surface of the earth into said formation and producing products therefrom, said system comprising a source of RF power at the surface of the earth, first and second electrodes vertically spaced and insulated from one another and disposed within said formation in the same borehole, coaxial conductors connecting said source to respective said electrode for energizing said electrodes, said coaxial conductors including a tubular inner conductor, means for pumping liquid from the location of the lower of said first and second electrodes through said inner conductor to the surface of the earth, and isolation means at the surface of the earth for electrically isolating said inner conductor from ground potential and recovering said liquid from said inner conductor at ground potential.

26. A system according to claim 25 further including means for monitoring the impedance of the power circuit from said source to and including said formation.

27. A system according to claim 25 further including means for measuring downhole temperature and pressure at said formation.

28. A system according to claim 25 further including means for measuring and controlling downhole pressure.

29. A system according to claim 25 wherein said first and second electrodes are vertically spaced by insulating means by at least one eighth the thickness of said formation.

30. A system for electrically heating a subsurface formation remote from the surface of the earth through a borehole extending from the surface of the earth into said formation and producing products therefrom, said system comprising a source of RF power at the surface of the earth, first and second electrodes vertically spaced and insulated from one another and disposed within said formation, coaxial conductors connecting said source to respective said electrodes for energizing said electrodes, said coaxial conductors including a tubular inner conductor, means for pumping liquid from the location of the lower of said first and second electrodes through said inner conductor to the surface of the earth, isolation means at the surface of the earth for electrically isolating said inner conductor from ground potential and recovering said liquid from said inner conductor at ground potential, and isolation means for restricting current flow in the outer of said conductor from the higher of said first and second electrodes.

31. A system for electrically heating a subsurface formation remote from the surface of the earth through a borehole extending from the surface of the earth into said formation and producing products therefrom, said system comprising a source of RF power at the surface of the earth, first and second electrodes vertically spaced and insulated from one another and disposed within said formation, coaxial conductors connecting said source to respective said electrodes for energizing said electrodes, said coaxial conductors including a tubular inner conductor, means for pumping liquid from the location of the lower of said first and second electrodes through said inner conductor to the surface of the earth, and isolation means at the surface of the earth for electrically isolating said inner conductor from ground potential and recovering said liquid from said inner conductor at ground potential, said isolation means including a tubular choke coil for conveying said liquid from said inner conductor to ground potential.

32. A system for electrically heating a subsurface formation remote from the surface of the earth through a borehole extending from the surface of the earth into said formation and producing products therefrom, said system comprising a source of electrical power at the surface of the earth, at least one electrode disposed within said formation, a tubular conductor connecting said source to said electrode for energizing said electrode, said conductor being insulated from ground, means for pumping liquid from the location of said electrode through said tubular conductor to the surface of the earth, and isolation means at the surface of the earth for electrically isolating said conductor from ground potential and recovering said liquid from said conductor at ground potential, said isolation means including a tubular choke coil for conveying said liquid from said conductor to ground potential.

* * * * *

UNITED STATES PATENT AND TRADEMARK OFFICE

CERTIFICATE OF CORRECTION

PATENT NO. : 4,524,827

DATED : June 25, 1985

INVENTOR(S) : Bridges, et al.

It is certified that error appears in the above-identified patent and that said Letters Patent is hereby corrected as shown below:

Abstract, line 2, after "which" insert --a--.

Column 4, line 1, change "$\mu_s$" to --$\mu_e$"; and change "$\sigma_s$" to --$\sigma_e$--.

Column 12, line 9, change "conductor" to --conductors--.

Signed and Sealed this

*Twenty-first* Day of *January 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,524,827

DATED : June 25, 1985

INVENTOR(S) : Jack E. Bridges, et al.

It is certified that error appears in the above-identified patent and that said Letters Patent is hereby corrected as shown below:

Column 1, after the first paragraph insert the following paragraph: --The Government of the United States of America has rights in this invention pursuant to Contract No. DE-AC01-79ER10181 awarded by the U.S. Department of Energy.--

Signed and Sealed this

Twenty-eighth Day of November 1989

*Attest:*

JEFFREY M. SAMUELS

*Attesting Officer* *Acting Commissioner of Patents and Trademarks*